US010258856B2

(12) United States Patent
Conley

(10) Patent No.: US 10,258,856 B2
(45) Date of Patent: Apr. 16, 2019

(54) HEIGHT ADJUSTABLE COMBAT TRAINING ASSEMBLY AND METHOD OF OPERATION

(71) Applicant: Eric Conley, Pensacola, FL (US)

(72) Inventor: Eric Conley, Pensacola, FL (US)

(73) Assignee: Eric Dean Conley, Panama City Beach, FL (US)

( * ) Notice: Subject to any disclaimer, the term of this patent is extended or adjusted under 35 U.S.C. 154(b) by 25 days.

(21) Appl. No.: 15/494,652

(22) Filed: Apr. 24, 2017

(65) Prior Publication Data

US 2018/0304138 A1 Oct. 25, 2018

(51) Int. Cl.
*A63B 69/00* (2006.01)
*A63B 69/32* (2006.01)
*A63B 71/06* (2006.01)

(52) U.S. Cl.
CPC ..... *A63B 69/32* (2013.01); *A63B 69/004* (2013.01); *A63B 71/0622* (2013.01); *A63B 2071/0633* (2013.01); *A63B 2071/0694* (2013.01); *A63B 2225/093* (2013.01)

(58) Field of Classification Search
CPC ..... A63B 69/004–2069/0044; A63B 69/32–69/325; A63B 2225/093
See application file for complete search history.

(56) References Cited

U.S. PATENT DOCUMENTS 1,890,696 A * 12/1932 Rosenhahn ..... A63B 69/208 248/160
2,143,691 A * 1/1939 Goldberg ..... A63B 69/208 446/220
4,139,193 A * 2/1979 Felber ..... A63B 69/004 482/90
5,665,035 A * 9/1997 Tumminia ..... A63B 21/0552 482/83
6,786,854 B1 * 9/2004 Hsu ..... A63B 69/208 482/83
7,086,997 B1 * 8/2006 Fields ..... A63B 69/004 482/83
8,246,493 B1 * 8/2012 Ling ..... A63B 69/20 473/417
8,574,101 B2 * 11/2013 Wheelbarger ..... A63B 69/20 473/417
8,641,583 B2 * 2/2014 Chen ..... A63B 69/20 482/83
9,295,891 B1 * 3/2016 Higgins ..... A63B 69/32
(Continued)

*Primary Examiner* — Jennifer M Deichl

(57) ABSTRACT

A height adjustable combat training assembly and method of operation enables a practitioner to strike with a fist, kick, hurtle over, and reenact combat with a real person through use of a height adjustable series of shafts, target accessories, and elongated barriers that are manipulated into myriad configurations. A base portion is filled with a weighted substance to stabilize the assembly. A base shaft attached perpendicularly into the base portion. A height adjustable shaft extends from the base shaft in a sliding relationship that is measured with a height gauging instrument. Padded sleeves encapsulate both shafts for cushioning. A flexible member extends form the terminus of the height adjustable shaft. A terminal target rests on the terminus of the second sleeve. A label attaches to the sleeves. At least one target accessory detachably attaches to the shafts or sleeves, and includes linear arm, blocking arm, laser device, and fist.

20 Claims, 12 Drawing Sheets

(56) References Cited

U.S. PATENT DOCUMENTS

| | | | | |
|---|---|---|---|---|
| 9,839,827 | B1 * | 12/2017 | Roberts | A63B 23/12 |
| 2007/0197348 | A1 * | 8/2007 | Ku | A63B 69/24 482/83 |
| 2012/0129660 | A1 * | 5/2012 | Eem | A63B 69/203 482/83 |
| 2013/0324372 | A1 * | 12/2013 | Cuadrado | A63B 69/20 482/90 |
| 2014/0302969 | A1 * | 10/2014 | Chen | A63B 69/203 482/90 |

* cited by examiner

HEIGHT ADJUSTABLE COMBAT TRAINING ASSEMBLY AND METHOD OF OPERATION

CROSS REFERENCE OF RELATED APPLICATIONS

This application claims the benefits of U.S. provisional application No. 62/327,393, filed Apr. 25, 2016 and entitled The Original Noodle Target Training System, which provisional application is incorporated by reference herein in its entirety.

FIELD OF THE INVENTION

The present invention relates generally to a height adjustable combat training assembly and method of operation. More so, the present invention relates to a combat training assembly that enhances combat skills through the utilization and development of specialized training equipment and accessories that allow practitioners to execute techniques, maneuvers, and motions delivered on and around various types of three dimensional objects that simulate the form, feel, resistance and or motion of human anatomy; whereby the combat training assembly comprises a base portion that stabilizes the assembly; a generally rigid base shaft that affixes into the base portion; a base sleeve that envelopes the base shaft to provide cushioning; a generally resilient height adjustable shaft arranged in a slidable relationship with the base shaft and adjustable to a predetermined height, whereby the height adjustable shaft is operational to be raised, lowered, or removed for multiple training options, shipping, or storing; a coupling member adapted to couple the base shaft with the height adjustable shaft; a flexible member extending axially from the terminus of the height adjustable shaft to provide a soft target, a at least one target accessory that detachably attach from the height adjustable shaft in a generally perpendicular disposition, whereby the target accessories may rotate about the height adjustable shaft, and whereby the target accessories may be defined by animated characteristics; a visibility enhancement member integrated into the height adjustable shaft, the visibility enhancement member adapted to visually highlight the spatial positioning of the height adjustable shaft and the second sleeve; a height gauging instrument integrated into the height adjustable shaft, the height gauging instrument adapted to indicate the distal relationship between the height adjustable shaft and the base shaft; and a signaling device operationally attached to the height adjustable shaft, the signaling device operational to emit an audible signal upon movement by the height adjustable shaft.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, in many forms of codified systems of combat, such as martial arts, the skill of striking an object with hands or feet is practiced. By practicing the striking of hard objects, the muscles, tendons and bones of the hands, arms, feet and legs can be conditioned and strengthened. In this manner, a martial artist can strike objects much harder than flesh and bones without becoming injured.

Generally, martial arts training devices are used, among other things, to help people develop a wide variety of striking skills. For example, coil bags or punching bags are used to help people develop punching and kicking skills. Such bags may be useful for developing technique, however, they are typically large and thus do not facilitate the development of striking accuracy. Target bags, or smaller punching bags, may be used to help people develop the accuracy of their punches and kicks. Such punching bags and target bags typically rest on the floor at a fixed height or are suspended from above at a fixed height. Often, trainees are forced to buy multiple punching bags and target bags to practice various techniques and hone accuracy. For example, one punching bag might be used for kicking and another for punching, or multiple target bags might be used to practice kicking at different heights. The requirement for additional devices is undesirable. Further, such fixed devices are undesirable because they are static; not allowing the trainee to deviate from the positioning of the fixed targets.

One example is a traditional device referred to as the wooden dummy being comprised of wooden slats that pass through a larger vertically oriented cylindrical section of wood which simulate a torso with arm and leg appendages. However the wooden striking surfaces are rigid and do not allow the practitioner to safely strike with greater forces. The appendages are set at a fixed height and thereby greatly limiting the vertical range of interaction.

There is a great variety of objects that are used to train the striking skills of a martial artist. Such objects include, punching bags, kicking bags, sand bags and the like. However, one of the most widely used and popular striking targets is the wooden board. A wooden striking board is traditionally a one-foot square board of pine. The pine is typically about 1" thick. Such boards are used because they are relatively inexpensive and only break if they receive a forceful, well aimed blow. Thus, by practicing striking wooden boards, a martial artist not only conditions their body, the martial artist also learns accuracy and how to focus a blow.

Typically, the hanging heavy punching bag is one of the earliest forms of punching bag training devices. Hanging heavy bags suffer from several disadvantages, including the limitations presented by the requirement that such a bag must be hung from a ceiling or a space consuming stand. The installation is permanent, which requires a space within a home, gym, or garage dedicated exclusively for heavy bag training.

Furthermore, some coded combat or martial art styles do not focus on power moves, but rather flow and precision accuracy. Free standing training bags were developed as an effective alternative to hanging heavy bags that require physically mounting the hanging bags to structural elements. Free standing punching bags are typically mounted to a heavy base which rests on the ground surface and therefore do not require ceiling installation. Free standing punching bags are typically built upon a large weighted base filled with water or sand, which may weigh in excess of 275 pounds in order to keep the bag upright during use.

It is known in the art that disadvantages of the current free standing bag structures include, heavy weight making it difficult to transport or store away the weighted base sometimes crushes the foot of a striker when struck hard. Many free standing bags consist of hard material that when accidentally struck, cause injury to the student. The problem that this soft, flexible target system solves starts with unsafe training. Students/players/trainees/practitioners oftentimes train heavy or hard before proper technique is developed resulting in joint, bone, muscle, ligament, toe, finger, finger nail, toe nails, or other injuries.

Furthermore, students sometimes kick wrong resulting in injuries to themselves or to the target holders. Oftentimes they do not learn proper angles, hip positions, etc. before going for power. Instructors do not have "enough arms" to hold targets and guide students in the right positions while kicking, blocking, or striking hand held targets. Most Instructors do not have enough if any assistants/helpers knowledgeable in all areas to assist properly in training while keeping the class moving speedily.

It is also known that most targets, shields, and other kicking or striking material is made for heavy, hard, powerful strikes kicks or blocking using motion from others to teach proper technique. Most hand held targets if kicked harder than the holder can hold will fly out of the hand of the holder striking anything in its path most likely causing some form of damage. Most instructors use other students to hold targets slowing down or lessening learning time per student on the mat during class time.

Further, most standing, hanging, or mounted targets, shields, bags, or other striking devices are big, noisy, space consuming, heavy, permanent, hard or solid and cannot easily be put away when not in use, and are meant for indoor use only. Most other devices are not safe for every possible strike including finger strikes. Heavy, hard standing or hanging targets/shields invite power more than precision training.

Other proposals have involved martial arts training devices. The problem with these training devices is that they are not height adjustable and do not allow for pin point accuracy training. Also, they do not employ multiple realistic targets that emulate real life targets. Also, the targets are not padded. Even though the above cited training devices meets some of the needs of the market, a height adjustable combat training assembly and method of operation enables a practitioner to strike with a fist, kick, hurtle over, and reenact combat with a real person through use of a height adjustable series of shafts, target accessories, and elongated barriers that are manipulated into myriad configurations is still desired. It is also desirable to provide a combat training target assembly where one or multiple focus targets may be easily and interchangeably positioned at selected heights from the ground to allow any strike by the user and which permits the training of a beginner or advanced martial arts practitioner in multiple kicking and hand techniques.

SUMMARY

Illustrative embodiments of the disclosure are generally directed to a height adjustable combat training assembly and method of operation. The combat training assembly serves to enhance combat skills through the utilization and development of specialized training equipment and accessories that allow practitioners to execute techniques, maneuvers, and motions delivered on and around various types of three dimensional accessories that simulate the form, feel, resistance, and motion of human anatomy during combat, and specifically a codified combat like martial arts.

In some embodiments, the combat training assembly comprises a base portion that stabilizes the assembly. A generally rigid base shaft affixes into the base portion, at a generally perpendicular disposition. The base shaft may be vertical or horizontal, depending on the orientation of the base. A first sleeve envelopes the base shaft to provide cushioning.

In some embodiments, a generally resilient height adjustable shaft is arranged in a slidable relationship with the base shaft. The height adjustable shaft is also adjustable to a predetermined length in relation to the base shaft. In this manner, the height adjustable shaft is operational to be raised, lowered, or removed for multiple training options, shipping, or storing. A second sleeve envelopes the height adjustable shaft to provide cushioning. A coupling member is adapted to couple the base shaft with the height adjustable shaft.

In some embodiments, a flexible member extends axially from the terminus of the height adjustable shaft to provide a soft target. At least one target accessory detachably attaches from the height adjustable shaft in a generally perpendicular disposition. The target accessories provides a target for a practitioner. The target accessories are visually distinct from the height adjustable shaft. The target accessories may rotate about the height adjustable shaft, and also may be defined by animated characteristics.

In some embodiments, a visibility enhancement member integrates into the height adjustable shaft or the second sleeve, or both. The visibility enhancement member is adapted to visually highlight the spatial position of the height adjustable shaft, in relation to the base shaft and the target accessory. A height gauging instrument integrates into the height adjustable shaft. The height gauging instrument is adapted to indicate the distal relationship between the height adjustable shaft and the base shaft. A signaling device operationally attaches to the target end of the height adjustable shaft. The signaling device is operational to emit an audible signal upon movement by the height adjustable shaft.

In one aspect, a combat training assembly, comprising:

a base portion defined by a sidewall, a wide end, and a narrow end forming a base aperture, the sidewall, the wide end, and the narrow end defining a cavity, the base portion adapted to stabilize the assembly, the base portion configured such that a multiple base portions interlock for enhanced stability of the assembly;

a generally rigid base shaft defined by a base first end and a base second end, the base first end adapted to detachably affix in the base aperture;

a first sleeve adapted to at least partially envelope a substantial length of the base shaft, the first sleeve being sufficiently soft, so as to cushion the base shaft;

a height adjustable shaft defined by a coupling end and a target end, the coupling end joined with the base second end of the base shaft in a slidable relationship, whereby the height adjustable shaft is operational to be raised, lowered, or detached in relation to the base shaft, a second sleeve adapted to at least partially envelope a substantial length of the height adjustable shaft, the second sleeve being sufficiently soft, so as to cushion the height adjustable shaft;

a coupling member adapted to couple and detach the base shaft and the height adjustable shaft;

a height gauging instrument integrated into the height adjustable shaft, the height gauging instrument adapted to indicate the axial position of the height adjustable shaft in relation to the base shaft;

a flexible member extending axially from the target end of the height adjustable shaft;

at least one target accessory detachably attached to the height adjustable shaft in a generally perpendicular disposition, the at least one target accessory being visually distinct from the height adjustable shaft;

a visibility enhancement member integrated into the height adjustable shaft and the second sleeve, the visibility enhancement member adapted to visually highlight the spatial position of the height adjustable shaft and the second sleeve; and a signaling device operationally attached to the target end of the height adjustable shaft, the signaling device operational to emit an audible signal upon movement by the height adjustable shaft.

In another aspect, the sidewall of the base is defined by a fill hole.

In another aspect, base has a generally frustoconical shape.

In another aspect, the base is fabricated from at least one of the following: wood, steel, rubber, and formed light weight plastic.

In another aspect, the flexible member is a rubber tube.

In another aspect, the coupling member comprises a male grip disposed at the base second end of the base shaft, and an outside female screw tightener at the coupling end of the height adjustable shaft.

In another aspect, the assembly further comprises a rubber pad adapted to cover the coupling member.

In another aspect, the first sleeve and the second sleeve are fabricated from foam.

In another aspect, the height gauging instrument is a ruler.

In another aspect, visibility enhancement member is a bright color or pattern.

In another aspect, signaling device is a bell.

In another aspect, the assembly further comprises at least one label defined by at least one of the following: text, a logo, an image, a color, a pattern, and a texture.

In another aspect, the at least one label is disposed on the first sleeve, or the second sleeve, or both.

In another aspect, the at least one target accessory is defined by an animated characteristic.

In another aspect, the at least one target accessory includes at least one of the following: an arm having a ninety degree bend, a fist, a foot, an animal shape, and a laser device operable to aim a laser beam at a point.

In another aspect, the at least one target accessory is adapted to rotate about the height adjustable shaft, In another aspect, the at least one target accessory is adapted to squeak when forcibly engaged.

In another aspect, the assembly further comprises an adjustable adapter brace operational to support the target accessory on the base shaft or the height adjustable shaft.

In another aspect, the assembly further comprises at least two brackets adapted to be supported by the target end of two height adjustable shafts.

In another aspect, the at least two brackets are configured to form an acute angle.

In another aspect, the assembly further comprises at least one elongated barrier adapted to be supported by the at least two brackets.

In another aspect, the at least one elongated barrier is soft and flexible.

In another aspect, the assembly further comprises at least one sticker, the sticker defined by a Phosphor that radiates visible light after being energized.

One objective of the present invention is to provide a mobile martial arts focused training assembly that is height adjustable and has multiple accessories that enable a practitioner to strike kick, jump over, and dodge the components of the assembly with pin point accuracy.

Another objective is to provide a combat training assembly that is useful for both indoor and outdoor training and practice of martial arts techniques.

Another objective is to provide a height adjustable shaft and a base shaft that are encased in sleeves, so as to be soft, flexible, and adjustable targets designed with safety in mind.

Yet another objective is to provide a martial arts training device comprising a barrier for creating a target zone.

Yet another objective is to provide a combat training assembly that is intended for no contact or light to medium contact and is suitable for striking by physical blows from weapons, one's head, hand, elbow, knee, foot and even small joints.

Yet another objective is to enable the assembly to tip over when an unintended force is applied thereto.

Yet another objective is to provide training using proper angles, foot position, and hip positions.

Yet another objective is to provide a combat training assembly that is quiet, lightweight, easy to store, mobile, and operable indoors and outdoors.

Yet another objective is to provide a visibility enhancement member on the second sleeve and height adjustment shaft that aids in aiming kicks, striking, blocking, jump rolling, or hurdling the height adjustable shaft, the elongated barrier, or the target accessory.

Yet another objective is to provide a height gauging instrument adapted to indicate the axial position of the height adjustable shaft in relation to the base shaft, and in inches.

Yet another objective is to provide animated extendable accessories, such as a linear arm, a removable fist, a laser device operable to aim a laser beam, and a blocking arm having a 90° bend, so as to enhance the training exercise.

Yet another objective is to provide a tool that enhances muscle growth and strength through repetitive use.

Yet another objective is to provide a combat training assembly that is easy to use by a practitioner to aid in aiming kicks, striking, blocking, jump rolling, or hurdling the height adjustable shaft, the elongated barrier, or the target accessory.

Yet another objective is to provide an inexpensive to manufacture combat training assembly.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 13A illustrates a linear arm that replicates a human arm fully extended; FIG. 13B illustrates the removable fist attached to the terminus of the linear arm; FIG. 13C illustrates an exemplary laser device attached to the terminus of the linear arm; FIG. 13D illustrates an elevated side view of the detachable fist having a post that aligns the fist with the height adjustable shaft; FIG. 13E illustrates a frontal view of the detachable fist; FIG. 13F illustrates a second side view of the detachable fist; and FIG. 13G illustrates a side view of the laser device emitting a laser beam.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A height adjustable combat training assembly 100 and method 200 of operation is referenced in FIGS. 1-21B.

Figure 1:
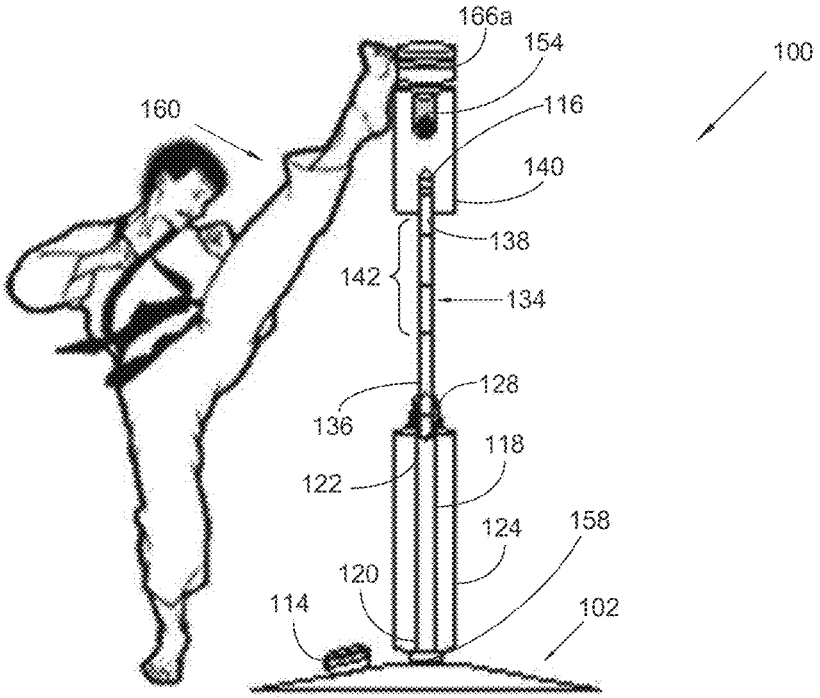
FIG. 1 illustrates a perspective view of a practitioner kicking an exemplary combat training assembly, such that a height adjustable shaft is forcibly extended out from a base shaft, in accordance with an embodiment of the present invention.

As FIG. 1 illustrates, the height adjustable combat training assembly 100, hereafter "assembly 100" enables a practitioner to strike with a fist, kick, hurtle over, and reenact combat with a real person through use of a height adjustable series of shafts, target accessories, and elongated barriers that can be manipulated into myriad configurations, dependent on the type of training desired. In essence, the assembly 100 helps a practitioner to execute techniques, maneuvers, and motions delivered on and around various types of three dimensional target accessories that simulate the form, feel, resistance, and motion of human anatomy during combat, and specifically a codified combat like martial arts.

Figure 2:
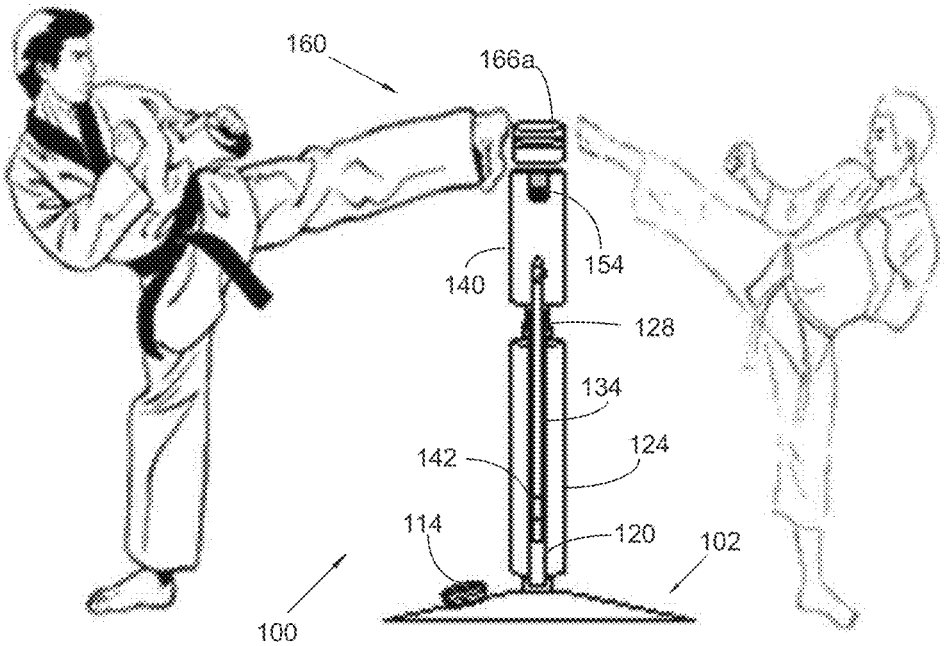
FIG. 2 illustrates a perspective view of two practitioners kicking an exemplary terminal target on a combat training assembly, in accordance with an embodiment of the present invention.

For example, FIG. 1 illustrates a perspective view of a practitioner kicking an exemplary combat training assembly 100, such that a height adjustable shaft 134 is forcibly extended out from a base shaft 118. And FIG. 2 illustrates a perspective view of two practitioners kicking an exemplary terminal target on a combat training assembly 100. Though there are myriad different combinations of combat training exercises that can be performed with the assembly 100, as discussed below.

Figure 3:
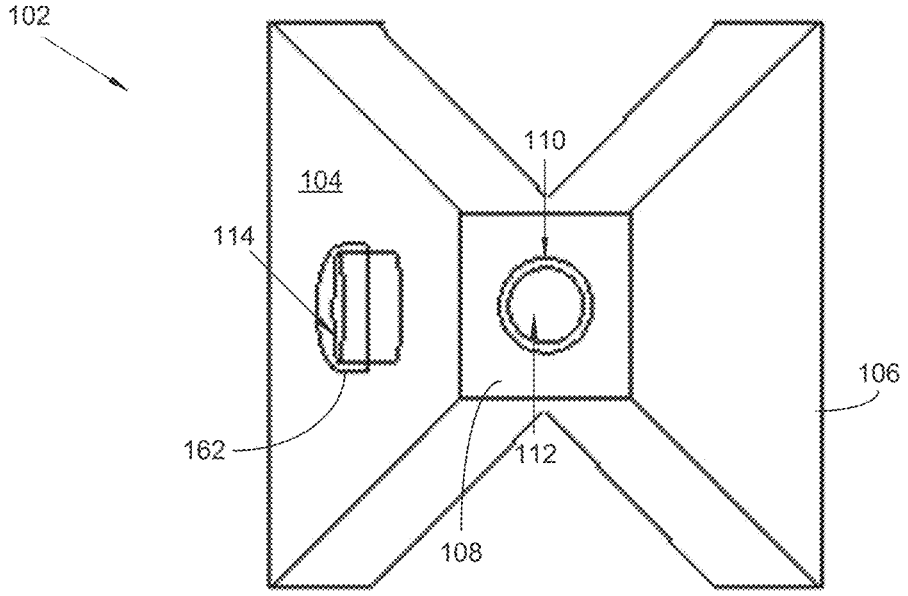
FIG. 3 illustrates a top view of an exemplary base portion, in accordance with an embodiment of the present invention.
Figure 4:
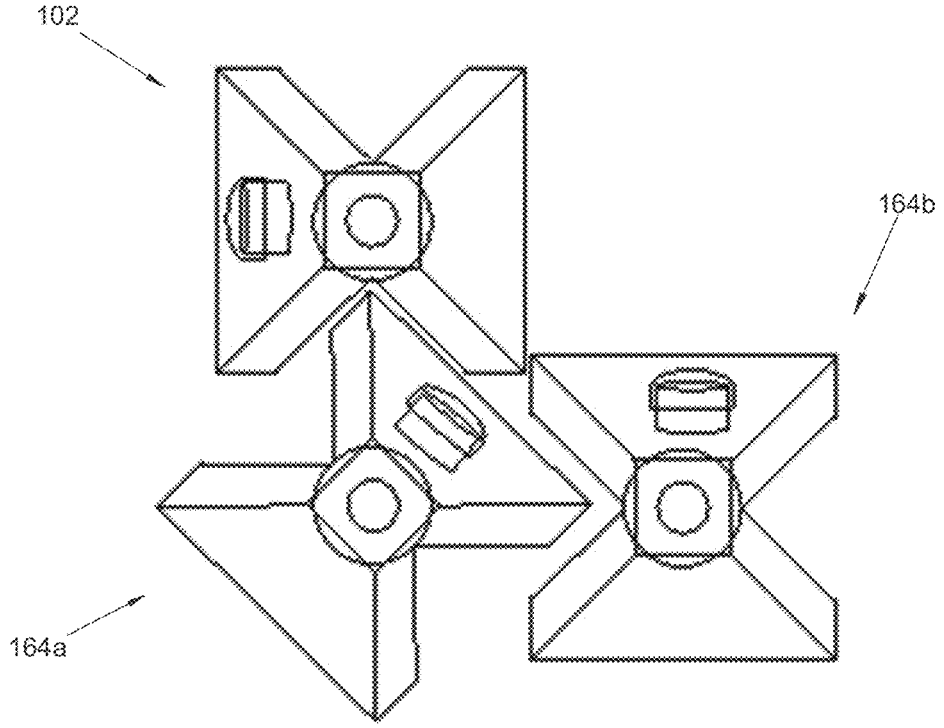
FIG. 4 illustrates a top view of an exemplary base portion, in accordance with an embodiment of the present invention.

As referenced in FIG. 3, the combat training assembly 100 comprises a base portion 102 that stabilizes the assembly 100. The base portion 102 is defined by a sidewall 104, a wide end 106, and a narrow end 108 forming a base aperture 110. In one embodiment, the sidewall 104, the wide end 106, and the narrow end 108 define a cavity 112. A fill hole 114 forms in the sidewall 104. The fill hole 114 enables passage of a heavy granular substance into the cavity 112 of the base portion 102. The heavy granular substance inhibits the base portion 102 from tipping over when the assembly 100 is disturbed with a force, such as a punch, a kick, and the like. In this manner, the base portion 102 adapted to stabilize the assembly 100. To enhance the stability, multiple base portions 102, 164*a*, 164*b* may interlock for enhanced stability (FIG. 4). The assembly 100 does not need to be mounted to any surface, since the base portion 102 can simply rest on a ground surface.

As discussed above, and shown in FIG. 4, multiple base portions 102, 164*a*, 164*b* can be set side by side, or angled with an interlocking design allowing the base portions 102, 164*a*, 164*b* to set angled for a closer fit. The multiple base portions 102, 164*a*, 164*b* can be arranged in various patterns including, random, circular, square, rectangular, and random patterns.

The base portion 102 may be tapered on all edges. The base portion 102 may also have a 90° notch cut out from opposite sides. The base portion 102 may also be flat at the top of the narrow end 108. The base aperture 110 that forms in the narrow end 108 is configured to enable a pressed fit female style screw fitting connector to be edge of the base portion 102 installed.

In one possible embodiment of the base portion 102, the fill hole 114 may include an elevated sealable screw opening allowing the base to be filled with sand or water. On one edge of the base portion 102, a screw cap plug 162 is used to fully seal the intended water or sand in the cavity 112 of the base portion 102.

In some embodiments, the base portion 102 may have a generally frustoconical shape. Though other shapes are possible including, without limitation, a peer medical shape, a disc-shaped, a cube shaped, and a rhombus shape. In some embodiments, the base portion 102 is fabricated from at least one of the following: wood, steel, rubber, and formed light weight plastic.

Figure 5:
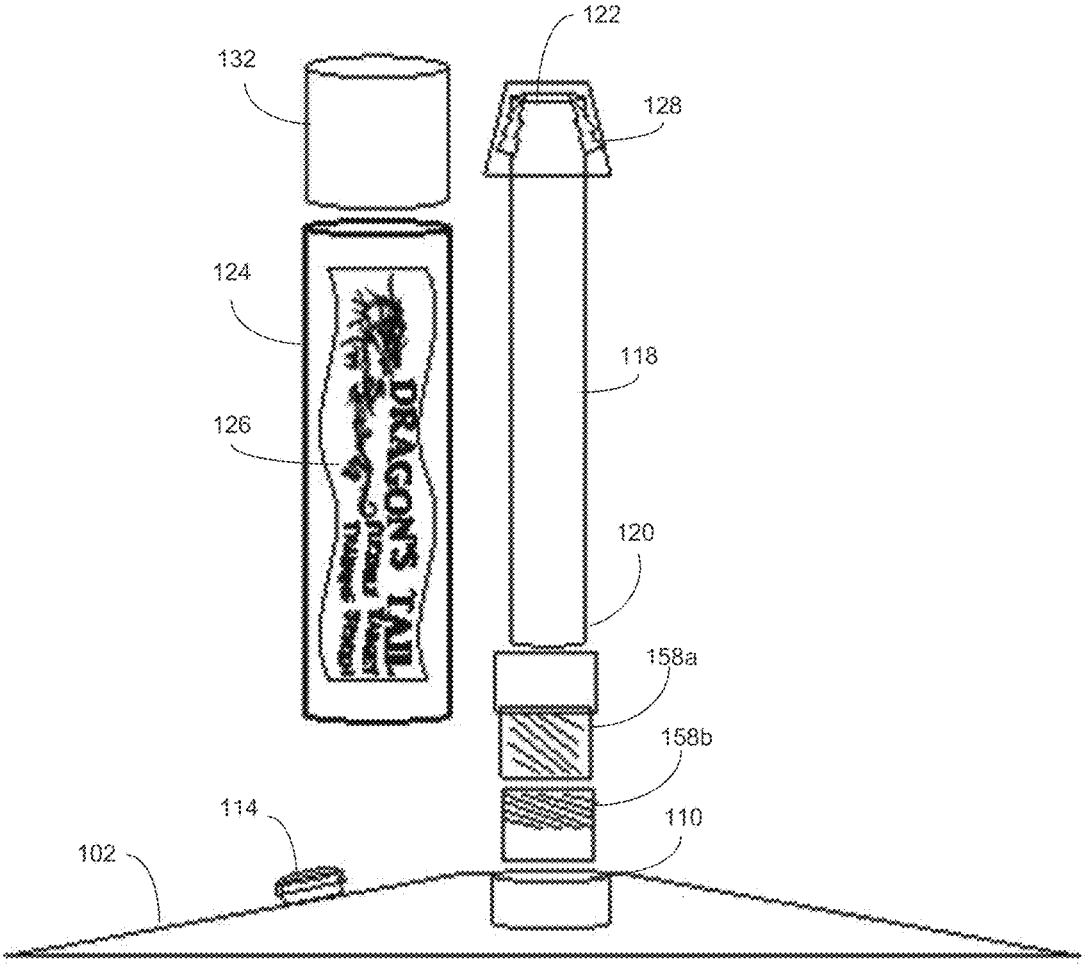
FIG. 5 illustrates a sectioned view of an exemplary base shaft and first sleeve, in accordance with an embodiment of the present invention.

Turning now to FIG. 5, a generally rigid base shaft 118 affixes into the base portion 102, at a generally perpendicular disposition. The base shaft 118 is defined by a base first end 120 and a base second end 122. The base first end 120 is adapted to detachably affix in the base aperture 110 that forms in the base portion 102. The base first end 120 comprises at least one threaded connector 158*a*, 158*b* that is adapted to detachably attach to the base aperture 110. The orientation base shaft 118 may be vertical or horizontal, depending on the orientation of the base.

A first sleeve 124 is adapted to at least partially envelope a substantial length of the base shaft 118. The first sleeve 124 is sufficiently soft, so as to cushion the base shaft 118. The first sleeve 124 may include a foam that has a larger diameter than the base shaft 118 and slides over the base shaft 118 outer surface. The first sleeve 124 provides cushioning to a hand or a foot that may strike the generally rigid base shaft 118.

Figure 6:
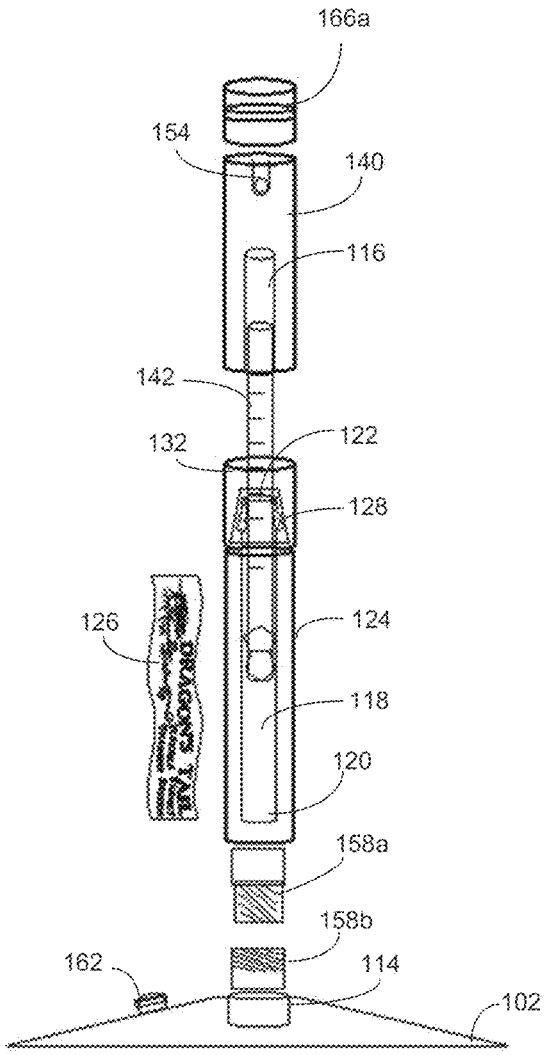
FIG. 6 illustrates a sectioned view of an exemplary combat training assembly, showing the height adjustable shaft extended from the base shaft, and showing a label for attachment to the first sleeve, in accordance with an embodiment of the present invention.

As illustrated in FIG. 6, a generally resilient height adjustable shaft 134 is arranged in a slidable relationship with the base shaft 118. The height adjustable shaft 134 is defined by a coupling end 136 and a target end 138. The coupling end 136 joins with the base second end 122 of the base shaft 118 in a slidable relationship. The height adjustable shaft 134 is adjustable to a predetermined length in relation to the base shaft 118. In this manner, the height adjustable shaft 134 is operational to be raised, lowered, or removed for multiple training options, shipping, or storing.

The base shaft 118 has a generally larger diameter than the height adjustable shaft 134. Thus, the height adjustable shaft 134 extends from, and retracts into the base shaft 118. This allows the height adjustable shaft 134 to be adjusted to an appropriate height for a practitioner to punch, kick, hurtle over, or perform any general combat training activities in relation to the height adjustable shaft 134.

Figure 7:
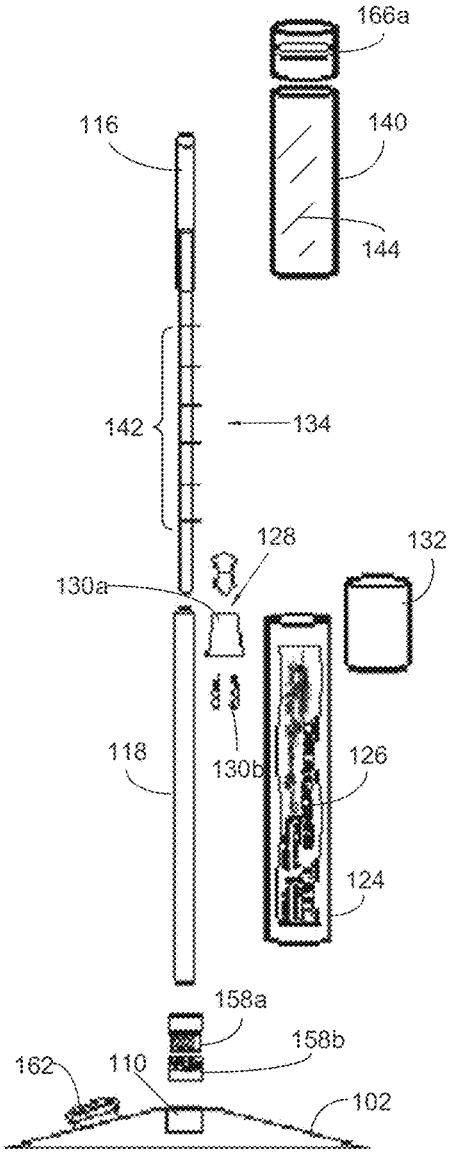
FIG. 7 illustrates a blow up view of the combat training assembly shown in FIG. 6, showing the height adjustable shaft extended from the base shaft, and showing a label for attachment to the first sleeve, and showing the coupling member separated into the male grip and the female tightening member, in accordance with an embodiment of the present invention.

Turning now to FIG. 7, a second sleeve 140 is adapted to at least partially encase a substantial length of the height adjustable shaft 134. The second sleeve 140 is sufficiently soft, so as to cushion the height adjustable shaft 134. The second sleeve 140 may include a foam that has a larger diameter than the height adjustable shaft 134 and slides over the height adjustable shaft 134 outer surface. The second sleeve 140 provides cushioning to a hand or a foot that may strike the height adjustable shaft 134.

Figure 8:
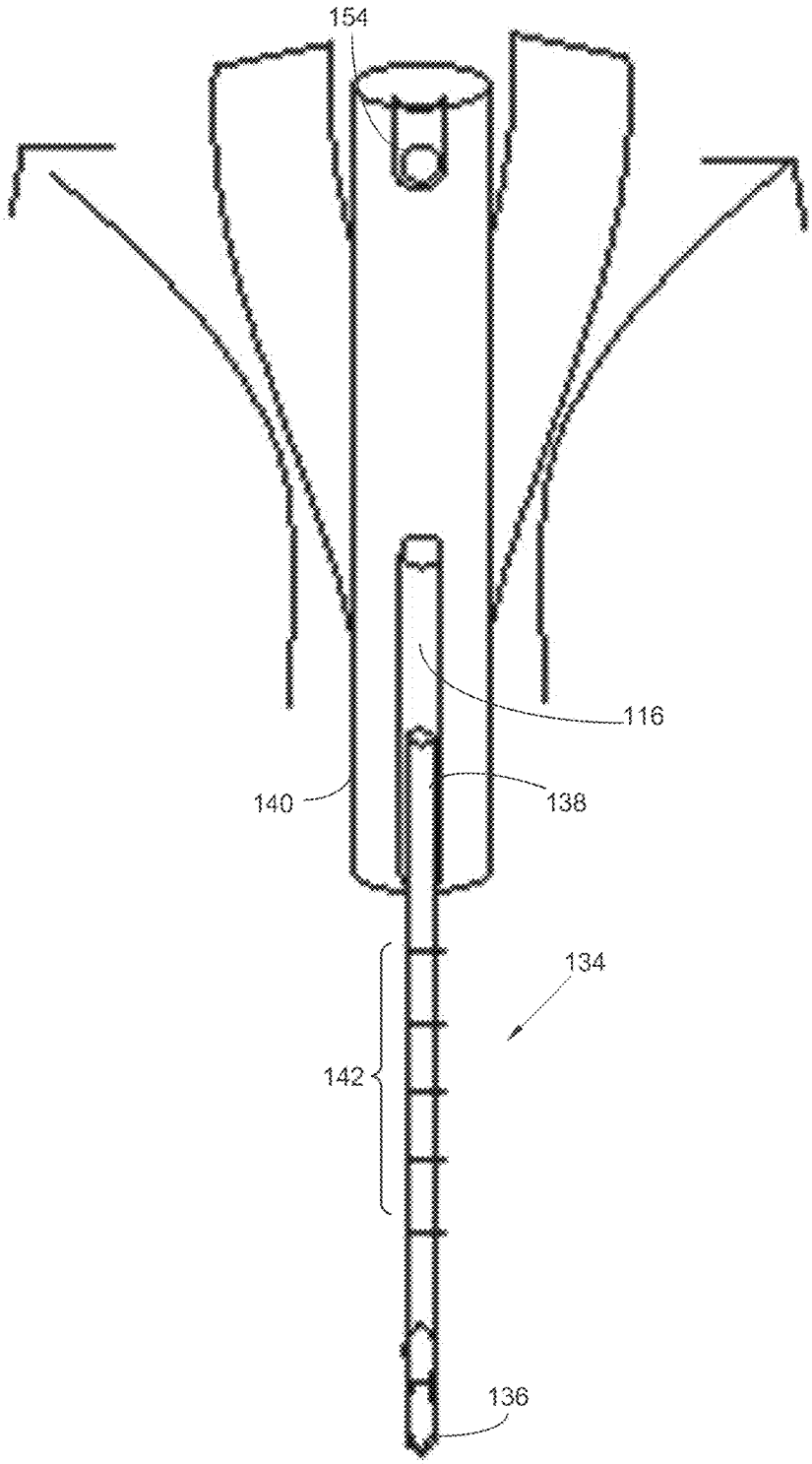
FIG. 8 illustrates a sectioned view of the second sleeve forced up from the height adjustable shaft in response to a strike, in accordance with an embodiment of the present invention.
Figure 9:
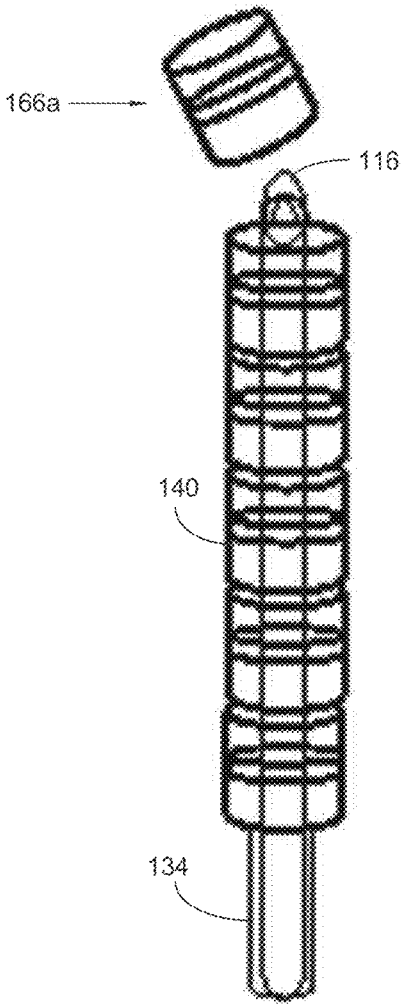
FIG. 9 illustrates a sectioned view of the second sleeve forcing the terminal target to detach, in accordance with an embodiment of the present invention.

In one example of the second sleeve 140 responding to force form a strike by the practitioner 160, FIG. 8 illustrates a sectioned view of the second sleeve 140 forced up from the height adjustable shaft 134 in response to a strike. FIG. 9 illustrates a sectioned view of the second sleeve forcing the terminal target 166*a*, 166*b* to detach, generally in response to a strike from the practitioner 160, such as an upward klick or punch. In yet another function of the second sleeve and the height adjustable shaft 134.

Figure 10:
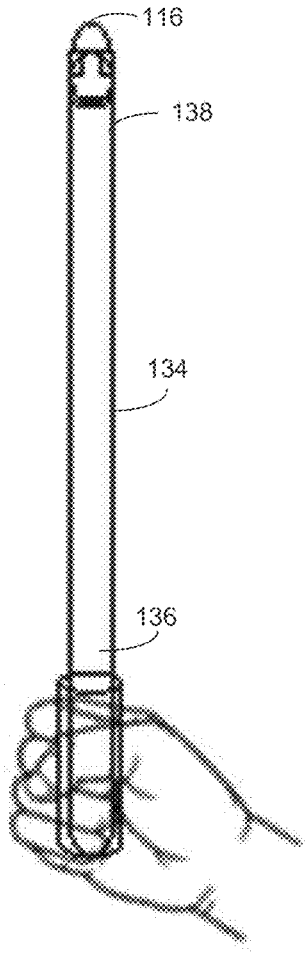
FIG. 10 illustrates a sectioned view of the height adjustable shaft with an attached flexible member, in accordance with an embodiment of the present invention.

As FIG. 10 illustrates, a flexible member 116 extends axially from the terminus of the height adjustable shaft 134. The flexible member 116 provide a soft area or target for a strike. In this manner, the practitioner 160 does not get injured striking a harder section of the height adjustable shaft 134. The flexible member 116 may include a rubber tube. In this manner, the base and height adjustable shaft 134*s* can be used in place of walls, chairs, etc. to use as an obstacle to not kick, but guide the position of the leg/hip in order to miss. This helps to develop faster snap kicks and more powerful kicks.

Figure 11:
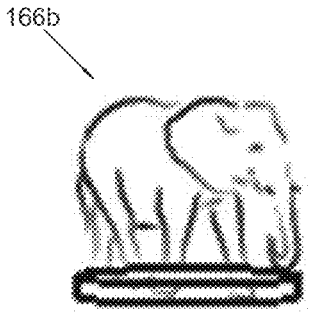
FIG. 11 illustrates a perspective view of an exemplary animal figurine terminal target, in accordance with an embodiment of the present invention.
Figure 12:
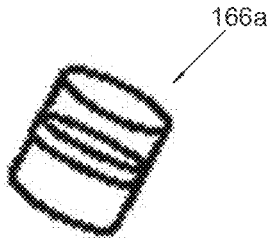
FIG. 12 illustrates a perspective view of an exemplary cylinder terminal target, in accordance with an embodiment of the present invention.

As illustrated in FIGS. 11 and 12, at least one terminal target 166*a-b* detachably attaches to the terminus of the second sleeve. The terminal target helps practitioner 160 aim the fist or foot during a strike in some embodiments, the terminal target may include a cylinder target 166*a*, or an animal figurine target 166*b*. Terminal target 166*a-b* can be detached from second sleeve through a forceful strike with the fist or foot.

Because the height adjustable shaft 134 and the attached flexible member 116 are resilient, they sway when impacted by a force from a kick, punch, or other inadvertent contact form the practitioner, as shown in FIG. 6. Thus the height adjustable shaft 134 is resistant to being tipped over. However, if kicked improperly or with an excessive force, the base portion 102 does tip over, allowing the kick to pass thru safely. It is significant to note that the prior art training targets are meant for heavy or hard impact and not necessarily for visuals and obstacles. Also the prior art does not allow for safe tipping over when extreme force is applied.

In some embodiments, a coupling member 128 is employed to detachably couple the base shaft 118 to the height adjustable shaft 134. In one possible embodiment, the coupling member 128 comprises a male grip 130*a* is operational at the base second end 122 of the base shaft 118, and an outside female screw tightener 130*b* is operational at the coupling end 136 of the height adjustable shaft 134. The male grip 130*a* engages the female screw tightener 130*b* through friction fit and a mechanical interlocking interaction. In this manner, a secure, but detachable interlocking relationship exists between the base shaft 118 and the height adjustable shaft 134.

In some embodiments, a rubber pad 132 is adapted to cover the coupling member 128. The rubber pad 132 provides further cushioning for the hand or foot or any other body part that may strike, kick, or otherwise engage that section of the assembly 100. In one embodiment, rubber pad 132 has a generally cylindrical shape that encapsulates the coupling member 128.

In some embodiments, a visibility enhancement member 144 integrates into the height adjustable shaft 134. The visibility enhancement member 144 is adapted to visually highlight the spatial position of the height adjustable shaft 134, in relation to the base shaft 118 and the target accessory. The visibility enhancement member 144 may include a brightly colored or patterned panel that adheres to the outer surface of the height adjustable shaft 134.

In one embodiment, the visibility enhancement member comprises a sticker 156 defined by a Phosphor that radiates visible light after being energized. The sticker 156 can be attached to a practitioner's hand or foot in visually aiming at the appropriate shaft or target accessory. Thus, another unique exercise enhancement offered by the assembly 100 involves actual visual enhancement that adhere to the practitioner while operating the assembly 100.

Those skilled in the art will recognize that this is a glow-in-the-dark arrangement. In any case the height adjustable shaft 134 is desirable be visually distinct so that a practitioner punches or kicks or hurtles the appropriate shaft, avoiding the base shaft 118 or any other components of the assembly 100. This may especially be useful for visually impaired practitioners.

A height gauging instrument 142 integrates into the height adjustable shaft 134. The height gauging instrument 142 is adapted to indicate the distal relationship between the height adjustable shaft 134 and the base shaft 118. In one embodiment, the height gauging instrument 142 is a ruler that extends along the length of the height adjustable shaft 134. The height gauging instrument 142 may be divided into increments of inches, centimeters, or any axial units.

In use, as the height adjustable shaft 134 is extended from the base shaft 118, a corresponding unit of the height gauging instrument 142 is revealed. Similarly, as the height adjustable shaft 134 is retracted into the base shaft 118, a corresponding unit of the height gauging instrument 142 is revealed. For example, the number of inches from the base are shown so that the height adjustable shaft 134 can be set at an appropriate height for a child, or an adult, or an extremely short or tall person.

A signaling device 154 operationally attaches to the target end 138 of the height adjustable shaft 134. The signaling device 154 is operational to emit an audible signal upon movement by the height adjustable shaft 134. The signaling device 154 helps the practitioner audibly determine if the height adjustable shaft 134 has been struck. In one embodiment the signaling device 154 is a bell. Though in other embodiments any device that emits an audible sound upon detecting motion or receiving a force may be used.

Looking back at FIG. 6, the assembly 100 further comprises at least one label 126 that affixes to the first sleeve 124, the base shaft 118, the second sleeve, or the height adjustable shaft 134. The label 126 may be defined by at least one of the following: text, a logo, an image, a color, a pattern, and a texture. The label 126 is efficacious for promotions, advertisements, visibility enhancement, instructions, motivational text, and any other combat training related message.

In yet another embodiment, the assembly 100 further comprises at least one sticker that detachably attaches to a practitioner's hand or foot in visually aiming at the appropriate shaft or target accessory. Thus, another unique exercise enhancement offered by the assembly 100 involves actual visual enhancement that adhere to the practitioner while operating the assembly 100. The sticker provides greater animation and ornamental quality to the assembly 100. This can especially be effective for encouraging or marketing to children practitioners. In one embodiment, the sticker is defined by a Phosphor that radiates visible light after being energized, i.e. glow-in-the-dark.

In one embodiment, the sticker is a removable vinyl that can be cut to size and applied to the skin to cover the back of the practitioner's hands. The sticker attaches to the first knuckle of all four fingers and thumb, also down the knife edge of the hand. In addition, a foot vinyl stickers apply to the top of the foot and also on the top knuckle of the toes. This design is comfortable and allows for movement of the hands and feet to keep full range of motion. In this manner, slippery gloves or socks are not required to participate in glow-in-the-dark activities.

Turning now to FIGS. 13A-13G, at least one target accessory detachably attaches from the first sleeve 124 that encapsulates the height adjustable shaft 134. The target accessory may be disposed in a generally perpendicular disposition in relation to the height adjustable shaft 134. In this manner, the target accessories provides a target for a practitioner to strike with a fist, kick with a foot, hurtle over, and generally interact with in a combat training exercise. Multiple target accessories can be used together, and in different combinations to provide myriad targets for the practitioner. The target accessories are generally designed to mimic human anatomy, or to have animated characteristics. This creates a more realistic combat training experience for the practitioner.

The at least one target accessory is visually distinct from the height adjustable shaft 134, or the base shaft 118, or both. In one embodiment, the target accessory may rotate about the height adjustable shaft 134. In another embodiment the target accessory may extend and retract in relation to the height adjustable shaft 134. In yet another embodiment the target accessory may swivel, pipit, vibrate, oscillate, or provide a generally rigid target. In yet another embodiment, the at least one target accessory is adapted to squeak when forcibly engaged. The needs of the combat training exercise dictate the selection of a desired target accessory, and the functionality of the target accessory.

In some embodiments, the target accessory may be small, foam, and light weight. This allows the target accessory to be safe for all types of strikes, kicks, and inadvertent contact. The target accessory is sufficiently soft so as to protect the practitioner from dangerous joint strikes, finger strikes; and even strikes from weapons such as bo staffs, scrima sticks, and batons. The target accessory can have optional strings attached for quicker retrieval.

In some embodiments, the target accessory may be colored or patterned differently than the sleeves or shafts for easy viewing. In one embodiment, the target accessory may be defined by an optional glow package, including glow in the dark targets, hand with first knuckle or knife hand stickers and foot with first knuckle stickers that all have a glow in the dark finish for fun glow parties.

In one embodiment, an accessory fastener 152, such as a hook and loop fastener, cord, tie, or Velcro strap, is employed to attach the target accessory perspective sleeve or shaft attach it to the to the shaft or sleeve. The accessory fastener 152 snuggly retains the target accessory in a desired orientation against the sleeve or shaft, while allowing the target accessory to be moved, raised, lowered and rotated around the shafts for easy adjusting.

In some embodiments, the target accessory may include, without limitation, a linear arm 146*a*, a removable fist 146*b*, a laser device 146*c* operable to aim a laser beam at a point, and a blocking arm 146*d* having a 90° bend. Though in other embodiments, the target accessory may include any object that resembles human anatomy or has animated characteristics to replicate a target.

Figure 13A:
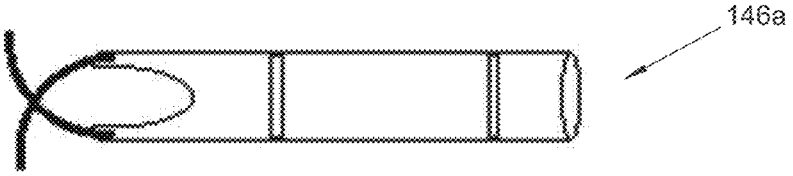
FIGS. 13A-13G illustrate perspective view of at least one target accessory, where
Figure 13B:
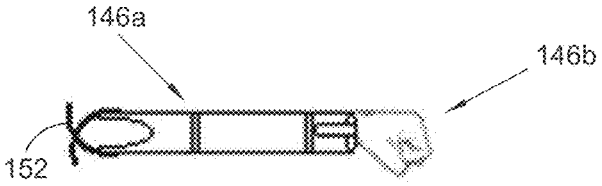
Figure 13C:
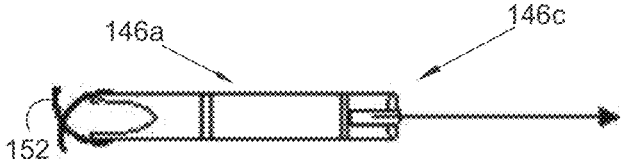
Figure 13D:
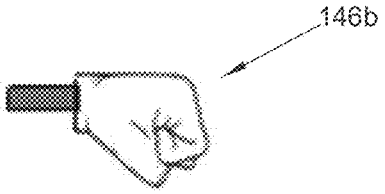
Figure 13E:
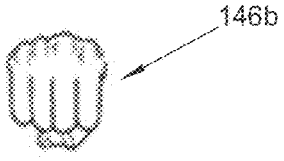
Figure 13F:
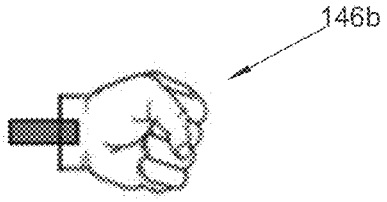
Figure 13G:
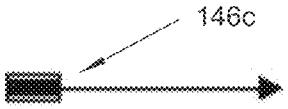

The target accessories 146*a-d* can be combined in any combination to achieve a desired action exercise for combat training. For example FIG. 13A illustrates the linear arm 146*a* that replicates a human arm fully extended. FIG. 13B illustrates the removable fist 146*b* attached to the terminus of the linear arm 146*a*. FIG. 13C illustrates the laser device 146*c* attached to the terminus of the linear arm 146*a* FIG. 131) illustrates an elevated side view of the detachable fist 146*b* having a post that aligns the fist 146*b* with the height adjustable shaft 134 134. FIG. 13E illustrates a frontal view of the detachable fist 146*b*. FIG. 13F illustrates a second side view of the detachable fist 146*b*. FIG. 13G illustrates a side view of the laser device 146*c* emitting a laser beam.

Figure 14:
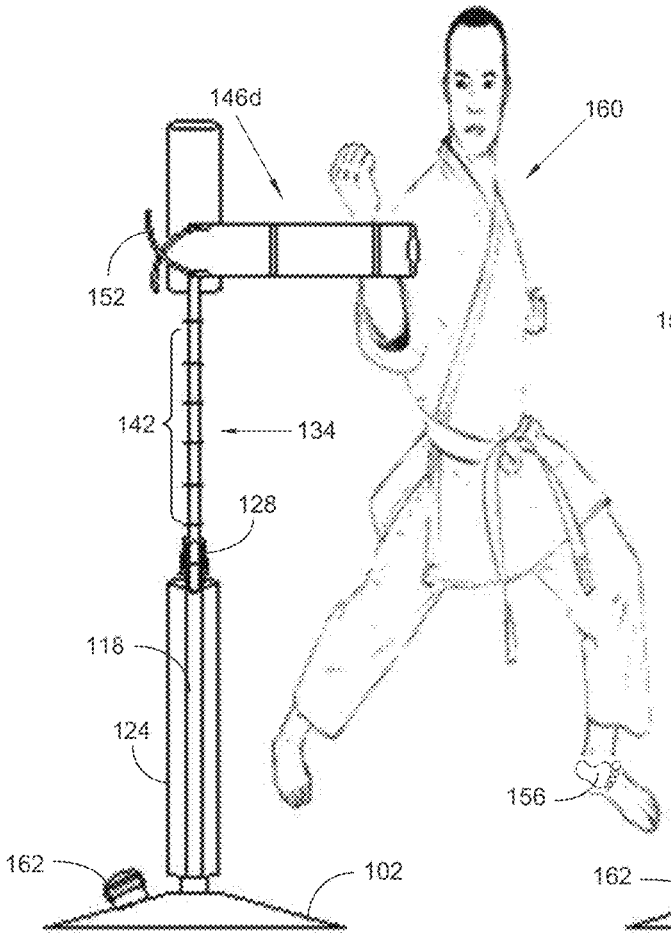
FIG. 14 illustrates a perspective view of a practitioner striking a blocking arm target accessory that is attached to the second sleeve, in accordance with an embodiment of the present invention.

Turning now to FIG. 14, the blocking arm 146*d* with a 90° bend is an animated plastic component that resembles a human blocking arm that bends about 90° at the elbow. The blocking arm 146*d* arm may attach to the first or second sleeve with an accessory fastener 152, such as a Velcro strap. Looking again at FIG. 14, the blocking arm 146*d* extends out from the height adjustable shaft 134, and the height adjustable shaft 134 is itself fully extended away from base shaft 118. In this manner, blocking arm 146*d* is used as a blocking tool resembling a person's arm. For example, this fully extendable blocking arm 146*d* replicates an adult punching at the practitioner 160.

Figure 15:
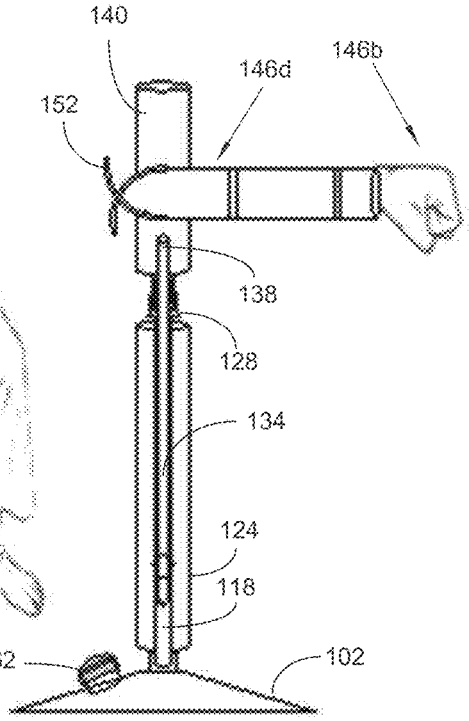
FIG. 15 illustrates a perspective view of a releasable fist target accessory attached to the blocking arm target accessory, in accordance with an embodiment of the present invention.

The blocking arm 146*d* is attachable to the shafts in a snug configuration, which still allows the arm to be removed, raised, lowered and rotated around the shafts for easy adjusting. In operation, for example, the arm with a 90° bend freely rotates about the height adjustable shaft 134 as a force engages the arm. In addition, the releasable fist 146*b* or the laser device 146*c* attaches to the terminus of blocking arm 146*d* to provide additional exercise capabilities (FIG. 15).

Figure 16:
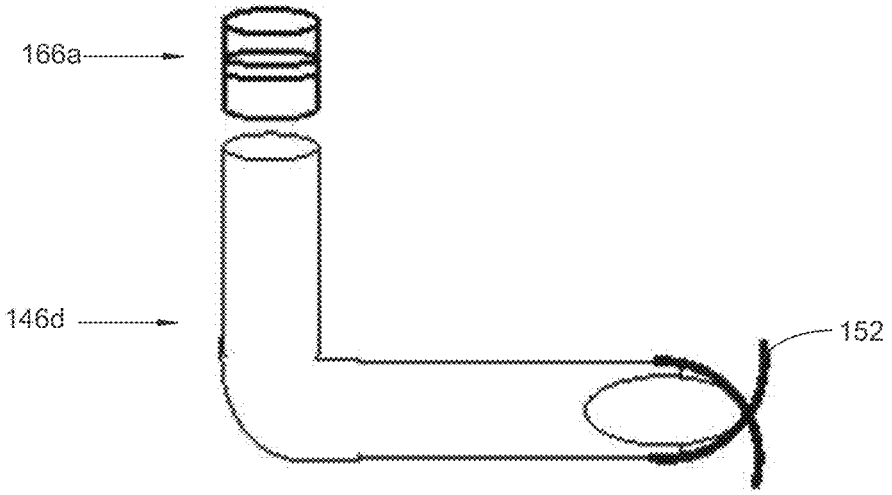
FIG. 16 illustrates a perspective view of the blocking arm target accessory with an attached cylinder terminus target, in accordance with an embodiment of the present invention.

In yet another embodiment, the blocking arm 146*d* has an elbow marker line to resemble the part of the elbow to strike simulating elbow breaks, and another forearm or wrist line to resemble the proper part of the wrist to block. As FIG. 16 shows, the terminal target 166*a* can also be employed with the blocking arm 146*d*. As discussed above, any combination of accessories and component from the assembly 100 may be combined in conjunction to achieve a desired combat training exercise.

Figure 17:
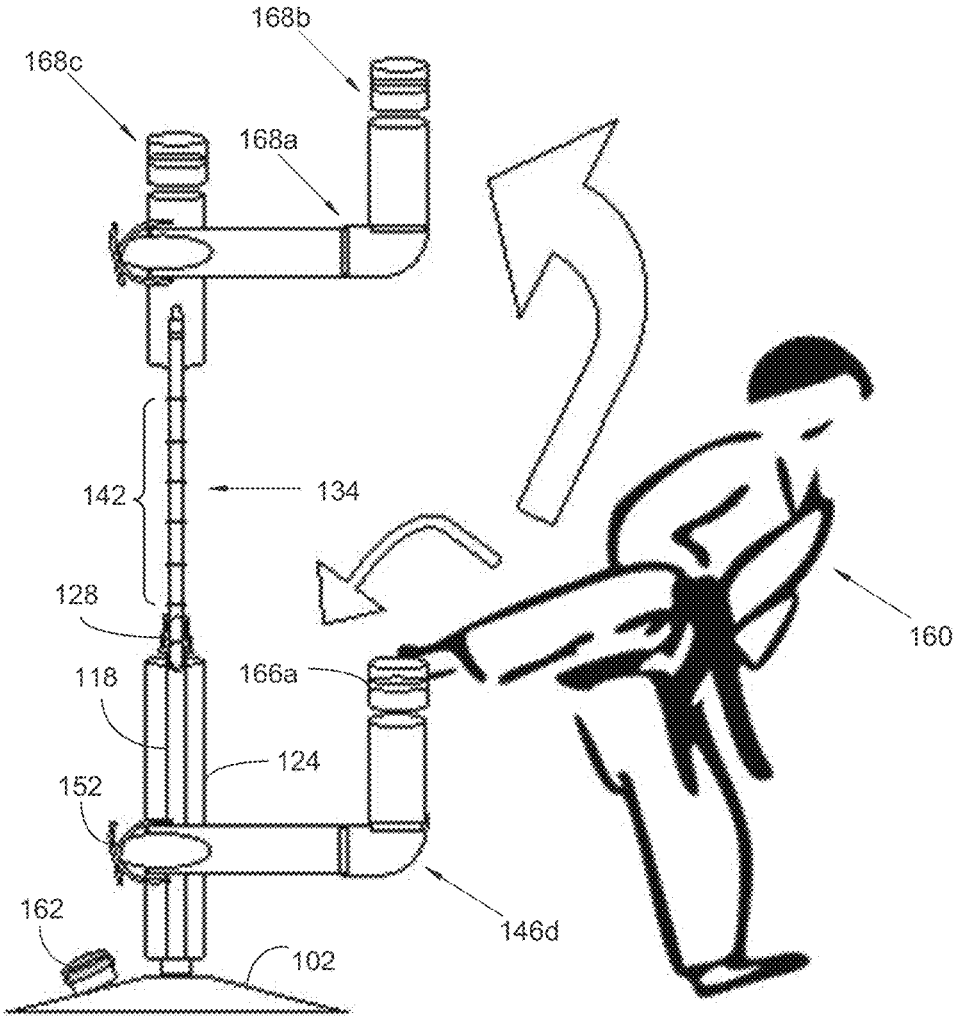
FIG. 17 illustrates a perspective view of a practitioner kicking a first and second blocking arm arranged on the first and second sleeve, respectively, in accordance with an embodiment of the present invention.

In yet another embodiment shown in FIG. 17, multiple arms can be set on each side of the height adjustable shaft 134, so as to enable instructor to teach technique as the practitioner learns. For example, a first blocking arm 146*d* with a coupled terminal target 166*a* fastens to the first sleeve 124 on the base shaft 118. A second blocking arm 168*a* having a second terminal target 168*b* coupled thereto attaches to the second sleeve of the height adjustment shaft. And further, a third terminal target 168*c* couples to the terminus of the second sleeve. The practitioner 160 can thus, punch or kick low or high in quick repetitive manner against both blocking arms 146*d*, 168*b*, and all three terminal targets 166*a*, 168*b*, 168*c*.

This provides structure with more available realistic arms to work with. The arm also allows for high/low or high/middle multiple blocks simulating arms. The arm can also swivel around for the instructor to mimic the movement of an attacker and still have two arms to guide and balance students.

In another possible embodiment of the target accessory, a removable hand set is used to properly simulate an attacker's arm. For example, the removable hand helps to instill proper execution of deflects in Hapkido giving a stopping point and better visuals. In yet another embodiment, Removable laser pointer to be used under supervision to pin point where the blocking arm points to during practicing showing proper body movements and or blocking positions. This helps instill correct body movements needed to properly execute blocks and deflects.

In some embodiments, an adjustable adapter brace 176*a*, 176*b* is used in conjunction with the target accessory to provide support at various heights along the base shaft 118 and the height adjustable shaft 134. The adapter brace 176*a-b* may rest on a ground surface to support the target accessory to a desired height. The adapter brace allows the lowest target accessory to rest above the ground surface and be adjusted all the way up to the terminus and of the height adjustable shaft 134.

In some embodiments, the adapter brace 176*a-b* may be attachable, movable, positional, and has a fill circular range around the respective shafts. The adapter brace is intended to be used for multiple techniques at the same time or continuous rapid fire techniques. Though it is significant to note, that the target accessory can attach to the base shaft 118 or the target shaft without use of the adapter brace.

The target accessory provides numerous advantageous. The target accessory provides a soft, flexible visual target to slowly or quickly aim at. The practitioner can learn proper pin point techniques before using powerful kicks or strikes. Beginner practitioners can practice dangerous finger strikes with this target system without the risk of injury, until they have built the strength needed to perform them properly.

Also, practitioners have a visual aid to aim kicks, strikes, blocks, at or to jump roll or hurdle over. The target accessory is unique in that it challenges kicking height and accuracy. In this manner, an instructor can easily teach and focus on multiple practitioners at one time. This makes combat training easier and safer. Also, the target accessory is a quick set up and exchange, even for small children. The target accessories also interchangeable and fast to arrange into myriad combinations.

Figure 18:
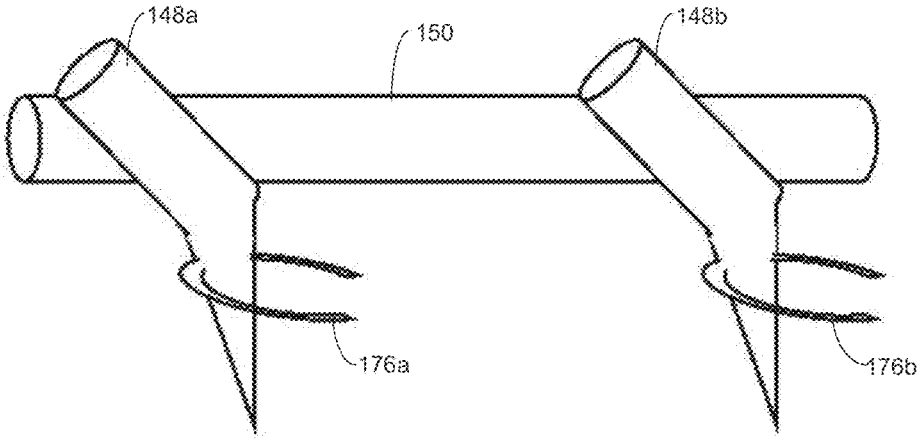
FIG. 18 illustrates a close up view of an exemplary two brackets supporting an elongated barrier, in accordance with an embodiment of the present invention.

As illustrated in FIG. 18, the assembly 100 is unique in that multiple assemblies 170*a*, 170*b* may be arranged to provide even greater number of targets, obstacles, and combat training equipment. By using multiple assemblies 170*a-b*, the possibilities of combat training are exponentially increased.

Figure 19:
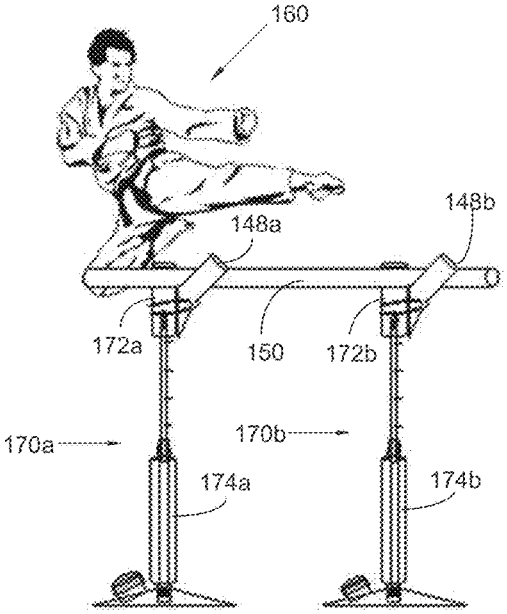
FIG. 19 illustrates a perspective view of a practitioner hurdling over the elongated barrier extending across the second sleeve of the height adjustment shaft, in accordance with an embodiment of the present invention.

As illustrated in the example of FIG. 19, the assembly 100 may provide at least two brackets 148*a*, 148*b* that support an elongated barrier 150 thereacross. The brackets 148*a-b* are adapted to be supported by the target end 138 of two height adjustable shaft 134*s* or second sleeves 172*a*, 172*b*; or the base shaft 118, or the first sleeve 124*s* 174*a*, 174*b*. The brackets 148*a-b* may attach around the first sleeve 124*s* 174*a-b* or the second sleeves 172*a-b* when they are enclosing their respective shafts. In any case, the brackets 148*a-b* form a snug fit around the respective sleeve or shaft.

In one embodiment the brackets 148*a-b* are generally V-shaped members that form an acute angle and fit snugly a round first or second sleeve 174*a-b*, 172*a-b*. The brackets 148*a-b* are used to support the elongated barrier 150. The elongated barrier 150 extends between at least two assemblies. In this manner, a practitioner is provided with an obstacle to hurtle over, kick over, or visualize a target over a predetermined height. In some embodiments the elongated barrier 150 is soft and padded, so as to minimize injury to the practitioner if the practitioner should strike the barrier.

Figure 20:
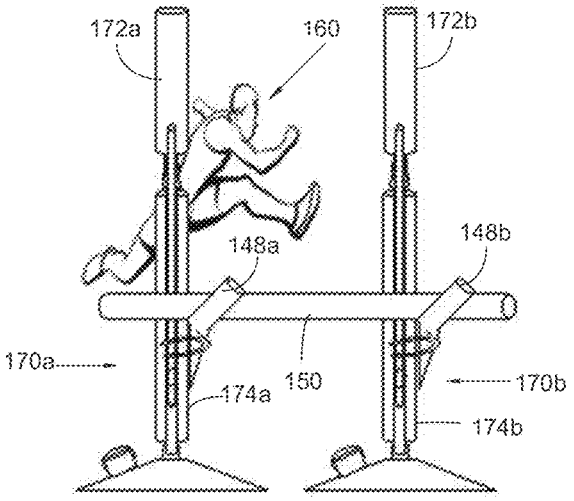
FIG. 20 illustrates a practitioner hurdling over the elongated barrier extending across the first sleeve of the base shaft, in accordance with an embodiment of the present invention.

As shown in FIG. 20, the elongated barrier 150 is effective for challenging the practitioner to run, jump over, crawl under, or roll through the elongated barriers. This is useful for agility training and spatial recognition. The elongated barrier 150 is bendable allowing for an up or contact while training. This allows for safe combat training. Further, the barrier 150 is easily knocked off the brackets 148*a-b*, which allow the practitioner 160 to jump over, under, or through the elongated barrier 150 without fear of injury.

The assembly 100 is suitable for beginner martial artists without undue cause for injury or pain that would hinder combat training. In some embodiments, the assembly 100 is used for, but not limited to striking, punching, kicking, hurdling, dodging, and jump rolling exercises. Further, because of the unique stability of the base portion 102, or multiple interlocked base portion 102*s*, the assembly 100 is resistant to being tipped over when forcefully engaged by the practitioner.

Figure 21A:
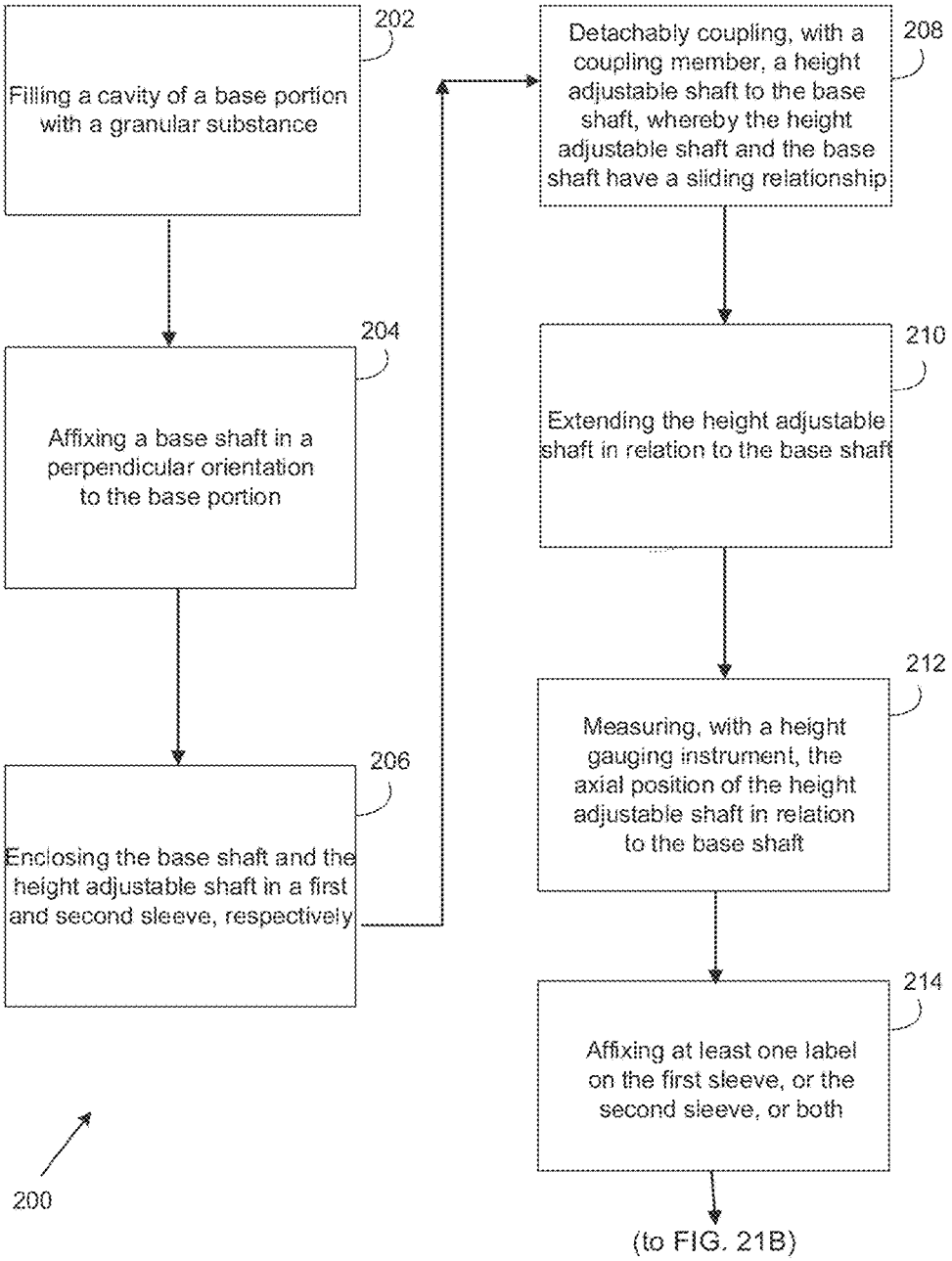
FIGS. 21A and 21B illustrate a flowchart of an exemplary method for operation of a combat training assembly, in accordance with an embodiment of the present invention.
Figure 21B:
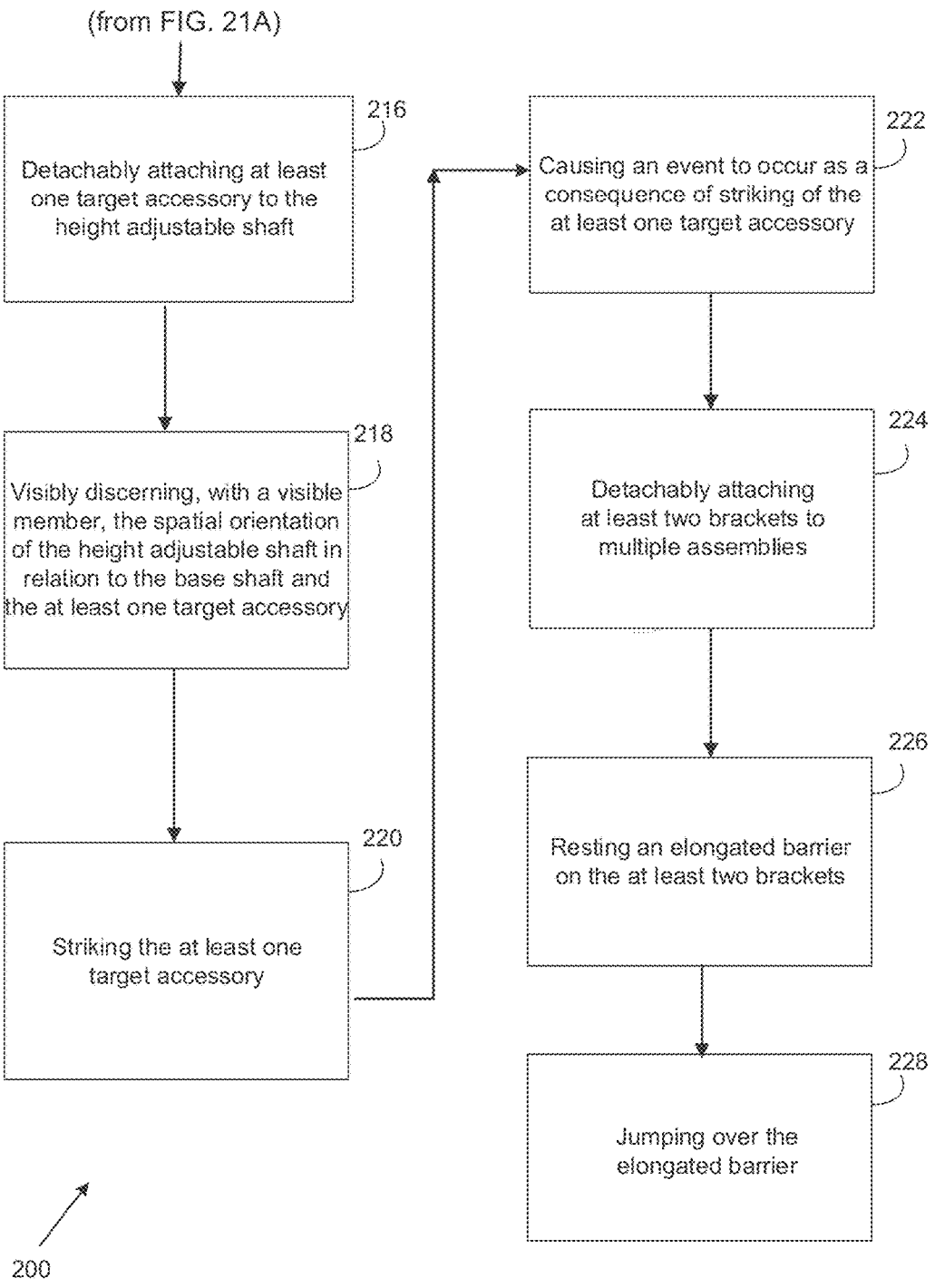

As referenced in the flowchart of FIGS. 21A and 21B, a method 200 for operation of the combat training assembly 100 comprises an initial Step 202 of filling a cavity 112 of a base portion 102 with a granular substance. The method 200 may further comprise a Step 204 of affixing a base shaft 118 in a perpendicular orientation to the base portion 102. A Step 206 includes enclosing the base shaft 118 and the height adjustable shaft 134 in a first and second sleeve, respectively.

In some embodiments, a Step 208 comprises detachably coupling, with a coupling member, a height adjustable shaft 134 to the base shaft 118, whereby the height adjustable shaft 134 and the base shaft 118 have a sliding relationship. A Step 210 includes extending the height adjustable shaft 134 in relation to the base shaft 118. In some embodiments, a Step 212 may include measuring, with a height gauging instrument 142, the axial position of the height adjustable shaft 134 in relation to the base shaft 118. A Step 214 comprises affixing at least one label 126 on the first sleeve 124, or the second sleeve, or both. A Step 216 includes detachably attaching at least one target accessory to the height adjustable shaft 134.

In some embodiments, a Step 218 comprises visibly discerning, with a visible member, the spatial orientation of the height adjustable shaft 134 in relation to the base shaft 118 and the at least one target accessory. A Step 220 includes striking the at least one target accessory. In some embodiments, a Step 222 may include causing an event to occur as a consequence of striking of the at least one target accessory A Step 224 comprises detachably attaching at least two brackets to multiple assemblies. Another Step 226 may include resting an elongated barrier on the at least two brackets. A final Step 228 includes jumping over the elongated barrier.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A combat training assembly, the assembly comprising:

a base portion defined by a sidewall, a wide end, and a narrow end forming a base aperture, the sidewall, the wide end, and the narrow end defining a cavity, the base portion adapted to stabilize the assembly, the base portion configured such that multiple base portions interlock for enhanced stability of the assembly;

a generally rigid base shaft defined by a base first end and a base second end, the base first end adapted to detachably affix in the base aperture;

a first sleeve adapted to at least partially envelope a substantial length of the base shaft, the first sleeve being sufficiently soft, so as to cushion the base shaft;

a height adjustable shaft defined by a coupling end and a target end, the coupling end joined with the base second end of the base shaft in a slidable relationship, whereby the height adjustable shaft is operational to be raised, lowered, or detached in relation to the base shaft;

a second sleeve adapted to at least partially envelope a substantial length of the height adjustable shaft, the second sleeve being sufficiently soft, so as to cushion the height adjustable shaft;

a coupling member adapted to detachably couple the base shaft to the height adjustable shaft;

a height gauging instrument integrated into the height adjustable shaft, the height gauging instrument adapted to indicate the axial position of the height adjustable shaft in relation to the base shaft;

a flexible member extending axially from the target end of the height adjustable shaft;

at least one target accessory detachably attached to the height adjustable shaft in a generally perpendicular disposition, the at least one target accessory adapted to be visually distinct from the height adjustable shaft;

a visibility enhancement member integrated into the height adjustable shaft and the second sleeve, the visibility enhancement member adapted to visually highlight the spatial position of the height adjustable shaft and the second sleeve; and a signaling device operationally attached to the target end of the height adjustable shaft, the signaling device operational to emit an audible signal upon movement by the height adjustable shaft.

2. The assembly of claim 1, wherein the sidewall of the base portion is defined by a fill hole.

3. The assembly of claim 1, wherein the base portion has a generally frustoconical shape.

4. The assembly of claim 1, wherein the first sleeve and the second sleeve are fabricated from foam.

5. The assembly of claim 1, wherein the coupling member comprises a male grip disposed at the base second end of the base shaft, and an outside female screw tightener at the coupling end of the height adjustable shaft.

6. The assembly of claim 1, further comprising a rubber pad adapted to cover the coupling member.

7. The assembly of claim 1, wherein the height gauging instrument is a ruler.

8. The assembly of claim 1, wherein the visibility enhancement member is a panel defined by a bright color or a pattern.

9. The assembly of claim 1, wherein the signaling device is a bell.

10. The assembly of claim 1, further comprising at least one label defined by at least one of the following: text, a logo, an image, a color, a pattern, and a texture.

11. The assembly of claim 10, wherein the at least one label is disposed on the first sleeve, or the second sleeve, or both.

12. The assembly of claim 1, wherein the at least one target accessory includes at least one of the following: a linear arm, a removable fist, a laser device 146*c* operable to aim a laser beam, and a blocking arm having a 90 degree bend.

13. The assembly of claim 1, further comprising an accessory fastener adapted to fasten the at least one target accessory to the first sleeve, the second sleeve, the base shaft, and the height adjustable shaft.

14. The assembly of claim 1, further comprising an adjustable adapter brace operational to support the target accessory along the length of the base shaft or the length of the height adjustable shaft.

15. The assembly of claim 1, further comprising at least one sticker configured to enable adherence to a practitioner, the at least one sticker defined by a phosphor that radiates visible light after being energized.

16. The assembly of claim 1, further comprising at least one terminal target detachably attached to a terminus of the second sleeve.

17. The assembly of claim 1, further comprising:

a first bracket configured to be supported by the target end or base shaft, a second combat assembly comprising a height adjustable shaft having a target and a base shaft, and a second bracket configured to be supported by the target end or base shaft of the second combat assembly.

18. The assembly of claim 17, further comprising at least one elongated barrier adapted to be supported by the first bracket and the second bracket.

19. A combat training assembly, the assembly comprising:

a base portion defined by a sidewall, a wide end, and a narrow end forming a base aperture, the sidewall, the wide end, and the narrow end defining a cavity, the sidewall of the base portion defined by a fill hole, the base portion adapted to stabilize the assembly, the base portion configured such that multiple base portions interlock for enhanced stability of the assembly;

a screw cap plug adapted to position in the fill hole;

a generally rigid base shaft defined by a base first end having a threaded connector and a base second end, the threaded connector of the base first end adapted to detachably attach to the base aperture;

a first sleeve adapted to at least partially envelope a substantial length of the base shaft, the first sleeve being sufficiently soft, so as to cushion the base shaft;

a height adjustable shaft defined by a coupling end and a target end, the coupling end joined with the base second end of the base shaft in a slidable relationship, whereby the height adjustable shaft is operational to be raised, lowered, or detached in relation to the base shaft;

a second sleeve adapted to at least partially envelope a substantial length of the height adjustable shaft, the second sleeve being sufficiently soft, so as to cushion the height adjustable shaft;

at least one terminal target detachably attached to the terminus of the second sleeve;

at least one label is disposed on the first sleeve, or the second sleeve, or both;

a coupling member adapted to detachably couple the base shaft to the height adjustable shaft;

a rubber pad adapted to cover the coupling member;

a height gauging instrument integrated into the height adjustable shaft, the height gauging instrument adapted to indicate the axial position of the height adjustable shaft in relation to the base shaft;

a flexible member extending axially from the target end of the height adjustable shaft;

at least one target accessory detachably attached to the height adjustable shaft in a generally perpendicular disposition, the at least one target accessory adapted to be visually distinct from the height adjustable shaft;

an accessory fastener adapted to fasten the at least one target accessory to the first sleeve, the second sleeve, the base shaft, and the height adjustable shaft;

an adjustable adapter brace operational to support the target accessory along the length of the base shaft or the length of the height adjustable shaft;

a visibility enhancement member integrated into the height adjustable shaft and the second sleeve, the visibility enhancement member adapted to visually highlight the spatial position of the height adjustable shaft and the second sleeve;

a signaling device operationally attached to the target end of the height adjustable shaft, the signaling device operational to emit an audible signal upon movement by the height adjustable shaft;

the first bracket configured to be supported by the target end or base shaft;

a second combat assembly comprising a height adjustable shaft having a target end and a base shaft; and a second bracket configured to be supported by the target end or base shaft of the second combat assembly, at least one elongated barrier adapted to be supported by the at least the first bracket and the second bracket.

20. A method for operation of a combat training assembly, the method comprising:

filling a cavity of a base portion with a granular substance;

affixing a base shaft in a perpendicular orientation to the base portion;

detachably coupling, with a coupling member, a height adjustable shaft to the base shaft, whereby the height adjustable shaft and the base shaft have a sliding relationship;

enclosing the base shaft and the height adjustable shaft in a first and second sleeve, respectively;

extending the height adjustable shaft in relation to the base shaft;

measuring, with a height gauging instrument, the axial position of the height adjustable shaft in relation to the base shaft;

affixing at least one label on the first sleeve, or the second sleeve, or both;

detachably attaching at least one target accessory to the height adjustable shaft;

visibly discerning, with a visible member, the spatial orientation of the height adjustable shaft in relation to the base shaft and the at least one target accessory;

striking, by a practitioner, the at least one target accessory;

causing an event to occur as a consequence of striking of the at least one target accessory;

detachably attaching at least two brackets to multiple assemblies;

resting an elongated barrier on the at least two brackets; and jumping over the elongated barrier.

* * * * *